United States Patent [19]

Wu

[11] Patent Number: 4,729,231

[45] Date of Patent: Mar. 8, 1988

[54] CHANGEABLE KEY TYPE LOCK BARREL

[76] Inventor: Tsay D. Wu, 2F, 33, Lane 119, Chulin Rd., Yung Ho City, Taiwan, Taiwan

[21] Appl. No.: 947,355

[22] Filed: Dec. 29, 1986

[51] Int. Cl.[4] ..... E05B 27/02; E05B 35/10

[52] U.S. Cl. ..... 70/383; 70/384

[58] Field of Search ..... 70/383, 384, 382, 376–378

[56] References Cited

U.S. PATENT DOCUMENTS

| | | | |
|---|---|---|---|
| 3,667,262 | 6/1972 | Hill | 70/384 |
| 4,069,694 | 1/1978 | Raymond | 70/383 |
| 4,376,382 | 3/1983 | Raymond | 70/383 |

*Primary Examiner*—Robert L. Wolfe

*Attorney, Agent, or Firm*—Asian Pacific International Patent and Trademark Office

[57] ABSTRACT

The present invention provides a lock barrel, particularly a changeable key type barrel which is characterized by using of a profile changing key to reset locking keys in the barrel by turning the barrel for 180 degrees and another profile changing key to restore the barrel to the original position by turning the barrel for 180 degrees but simultaneously the locking keys are pushed to different heights by means of some side plates to complete profile changing.

5 Claims, 18 Drawing Figures

CHANGEABLE KEY TYPE LOCK BARREL

BACKGROUND OF THE INVENTION

Living is an essential part of life, evidenced by the history of housing development, and lock was invented as a way to secure safe living. Though there are kinds of lock to safeguard houses, a lot of defects exist, such as:

1. Key brough away by any prior room-mate will make the present occupant unable to have full protection from the existing lock and the prior room-mate may access without any difficulty. Therefore, replacement of lock set is necessary after leaving of any room-mate and it means a waste of time and money.

2. Generally a fixed barrel is used for each lock set and thus variation of unlocking keys is limited, and replacement of barrel is expensive. Lock set of such kind can be broken or opened by burglar easily.

SUMMARY OF THE INVENTION

In view of the above defects, the inventor invented a changeable key type lock barrel to eliminated these defects.

The main objective of the present invention is to provide a lock barrel which can have profile of its locking keys changed by means of profile changing keys easily to avoid trouble in replacement of barrel and to ease change of the profile whenever required.

BRIEF DESCRIPTION OF DRAWINGS

FIG. 2-1 is the top view thereof.

FIG. 4-1 illustrates the sectional view on line A—A of FIG. 4.

FIG. 4-2 is the original profile of the key.

FIG. 4-3 is a sectional view on line B—B of FIG. 4-2.

FIG. 4-4 is the profile changing key which has the same barrel of the original key.

FIG. 4-5 is a sectional view on line C—C of FIG. 4-4.

FIG. 5 is a cross sectional view with the profile changing key inserting in the lock.

FIG. 5-1 is the sectional view on line D—D of FIG. 5.

FIG. 5-2 is another profile changing key which has a different barrel than the original key.

FIG. 6-1 is the sectional view on line E—E of FIG. 6.

FIG. 6-2 is the key having the same barrel of another profile changing key.

FIG. 7-1 is a sectional view on line F—F of FIG. 7.

DETAILED DESCRIPTION

Figure 1:
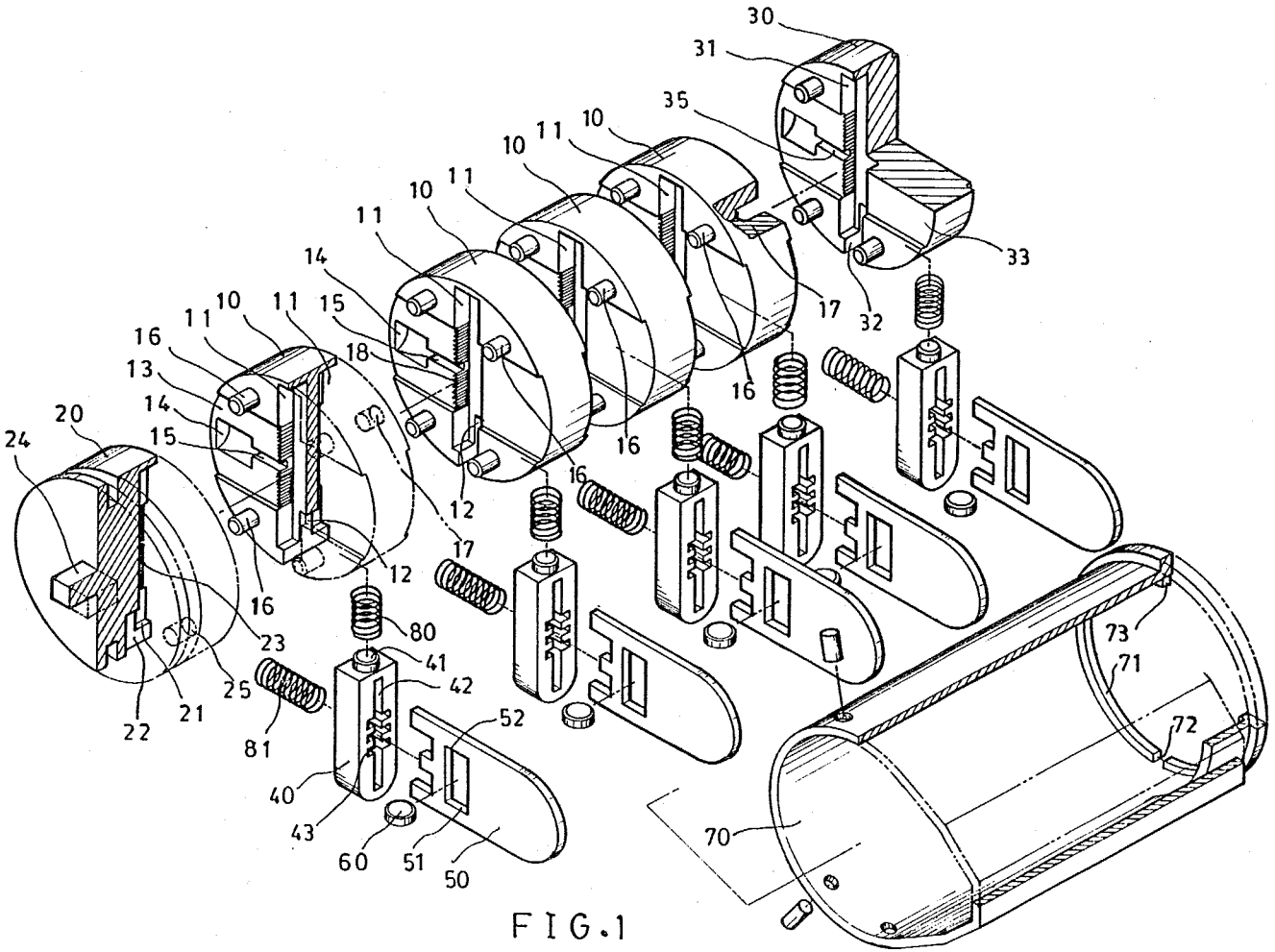
FIG. 1 is a perspective and fragmental view of the present invention.

Structure of the present invention is described below with reference to the attached drawings. As shown in FIG. 1, a perspective and fragmental view of the present invention, each rotary lock body (10) is in the form of a disk with two key slots (11) in the middle, each at a side. Each of the key slots (11) is connecting to a key way (12) in the bottom. A side slot (13) is designed perpendicular to each key slot (11). On each side slot (13) there is a spring seat (14) in the form of a semi-cylindrical slot, and there is a brake seat (15) in the form of a rectangular slot extending from an end of the spring seat (14). Each rotary lock body (10) has four cylindrical connection pins (16), each at a corner, and all located in one side. The other side of the rotary lock body (10) has two connection holes (17) corresponding to the said four connection pins (16). Each of the key slots (11) has an adapting edge (18) on one side.

The driving lock body (20) is in the form of a disk with a long key slot (21) at one side and a key way (22) in the bottom of the key slot (21). A side slot (23) is designed perpendicular to the key slot (21). Another side of the driving lock body (20) has a rectangular driving block (24) to open or close door bolt. On the driving lock body (20) there are four connection holes (25) corresponding to the connection pins (16).

The lock panel (30) is in the form of a disk with a long key slot (31) at one side and a key way (32) in the bottom of the key slot (31). A side slot (33) is designed perpendicular to the key slot (31). On the side slot (33) there is a semi-circular spring seat corresponding to the spring seat (14) on the rotary lock body (10). A brake seat (34) in the form of a slot is extending from an end of the spring seat and the brake seat (34) is corresponding to the brake seat (15) on the rotary lock body (10).

The locking key (40) is in the form of a bar with a round end and a spring brake block (41) in the form of a short cylinder on the top. Each locking key (40) has a longitudinal side slot (42), on which there are three (or, two or more) rectangular brake stoppers (43) perpendicular to the respective side slots (42).

The side plate (50) is in the form of a thin plate with a round end and three extension plates at another end. it has a rectangular brake holder (51) near the rear end.

The brake (60) is a round (or square with curved edges) thin plate.

The lock casing (70) is in the form of a cylinder with a protrusion along one side, and a flange (71) around the inner wall of one end. The flange (71) has a large opening (72) on the bottom, and a small opening (73) right above the large opening (72).

Figure 2:
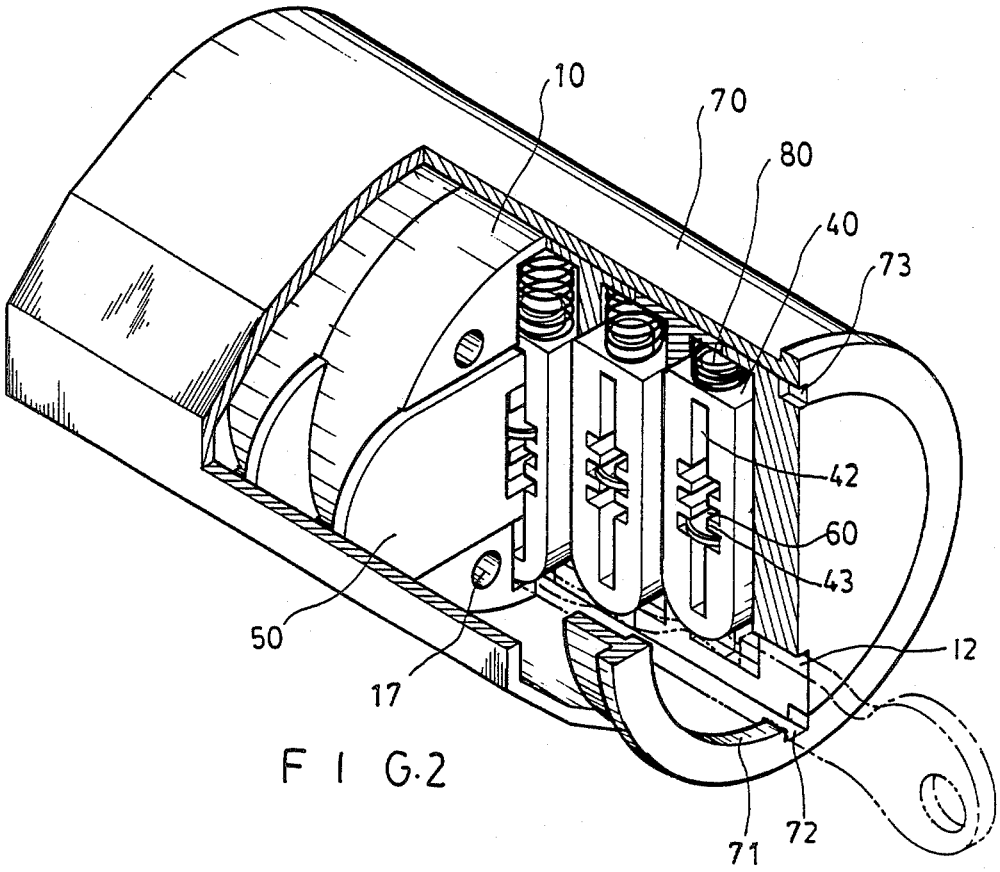
FIG. 2 is a perspective view of a lock assembly according to the present invention.
Figures 1, 2:
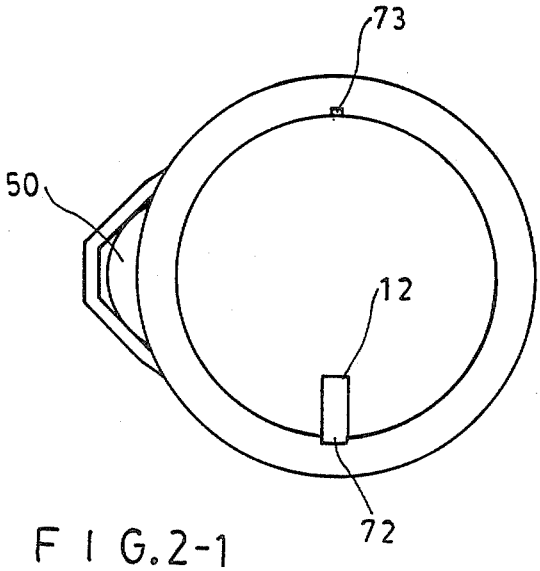
Figure 3:
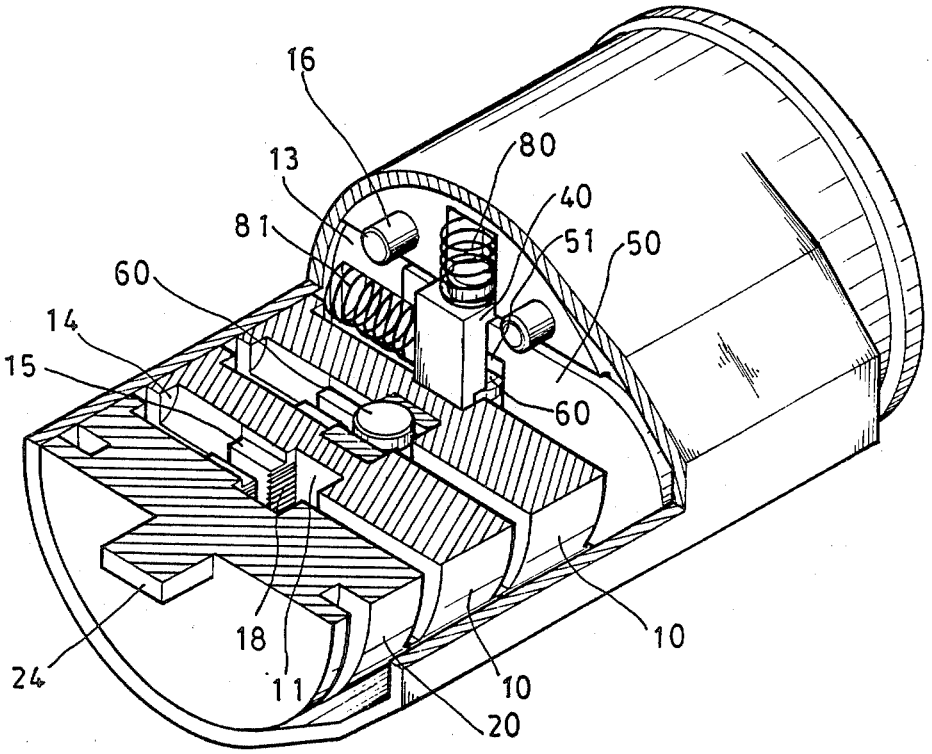
FIG. 3 is another perspective view of the lock assembly according to the invention.

For assembly, please refer to FIG. 1, FIG. 2, a perspective/cross sectional view of the present invention, and FIG. 3, another perspective/cross sectional view of the present invention. First of all, five (or any other number) brakes (60) are placed in five (or the other number) brake holders (51) of different heights, and such brakes (60) are then inserted into brake toppers (43) of different heights while the side plate (50) is inserted to the side slot (42). A locking key spring (80) is placed on the top of each locking key (40), and tail of each side plate (50) is fixed with a side plate spring (81) in a manner that the locking key springs (80) and the side plate springs (81) are kept respectively in spring seats (14) and top of key slots (11) formed among the rotary lock body (10), the driving lock body (20) and the lock panel (30). Hence, the side plate (50) is moveable in the side slot (13) under restriction by the side plate spring (81), and the locking key (40) is moveable under restriction by the locking key spring (80). Such rotary lock bodies (10) are connecting each other by means of the connection pins (16) and the connection holes (17), and then connected to the driving lock body (20) and the lock panel (30). The whole assembly is then placed in the lock casing (70) in a manner than the key way (22) is matching with the large opening (72) in the lock casing (70).

Figure 4:
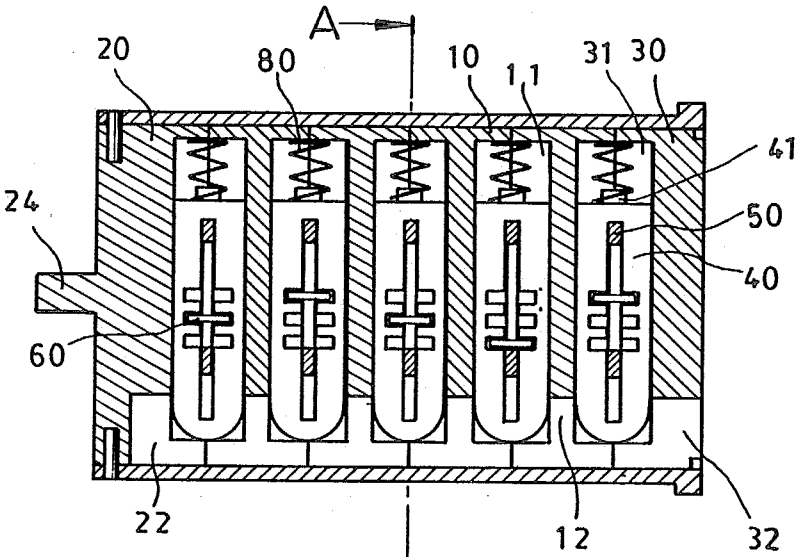
FIG. 4 is a sectional view thereof.
Figures 2, 4:
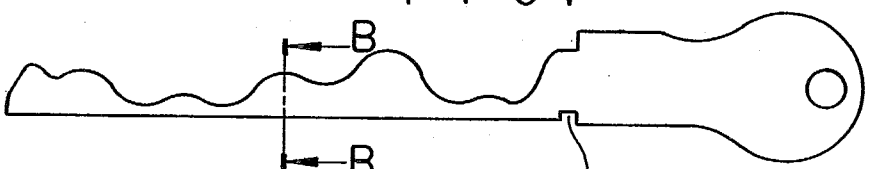
Figure 4:
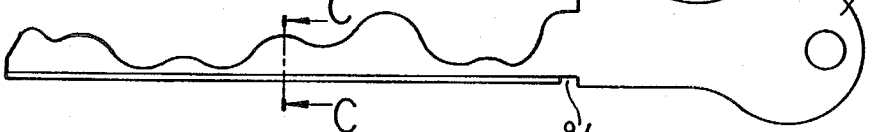
Figures 1, 4:
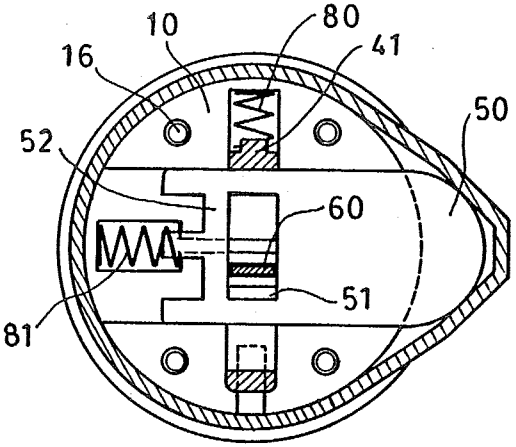
Figures 3, 4:
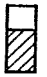
Figures 4, 5:
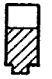
Figure 5:
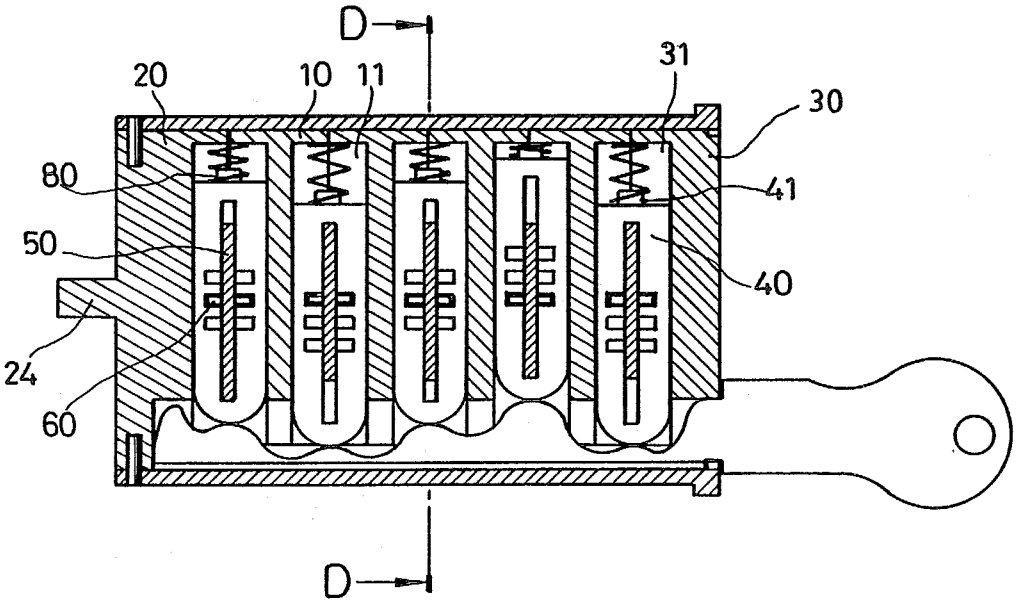
Figures 2, 5:
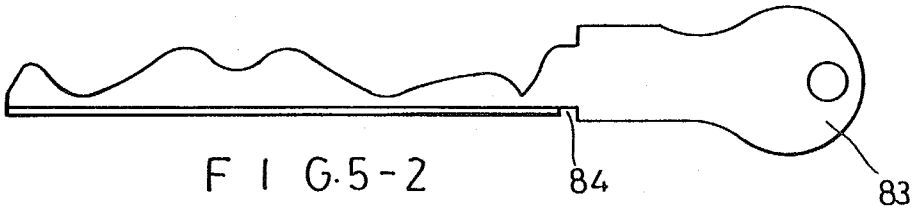
Figures 1, 5:
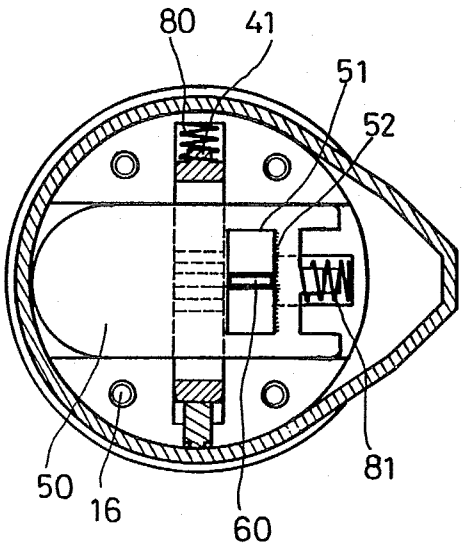
Figure 6:
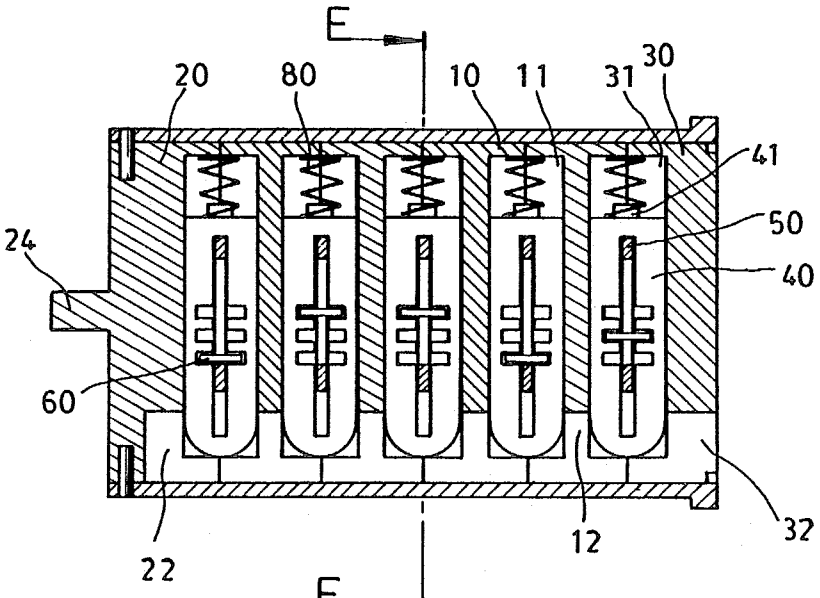
FIG. 6 is a profile changing barrel.
Figures 2, 6:
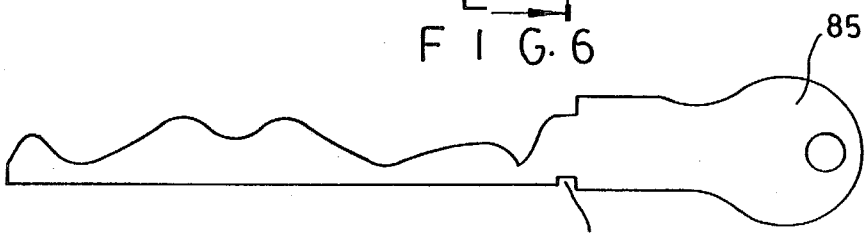
Figures 1, 6:
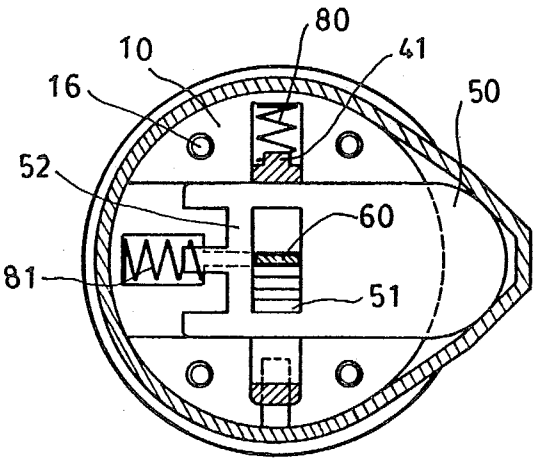

For application, please refer to FIGS. 4, 5 and 6 which illustrate profile changing according to the present invention. Suppose the barrel being used has a profile as shown in FIG. 4 or 5, and if it is desirous to change the profile of the key and barrel, the profile changing key I (82) being used is first inserted through the large opening (72) to push the locking keys (40) upwards till their respective brakes (60) are at the same level of the respective brake seats (15). Then, the key I (82) is turned to turn the whole assembly for 180 degrees. At this moment, side plates (50) in the protrusion portion of the lock casing (70) are forced by the turning to compress the side plate springs (81) so that the respective brakes (60) are pushed into the respective brake seats (15), that is, all the brakes (60) are reset, and the key I (82) is just in the small opening (73). The key I (82) has a thin lower edge with a width slightly smaller than that of the small opening (73). Thereafore, it can be withdrawn from the small opening (73) without affecting position of the brakes (60). All the locking keys (40) are kept compressed to the lowest bottom of the key slots (11) by compression of the locking key springs (80).

Another profile changing key II (83) is then inserted through the small opening (73) to turn the whole assembly. The key II (83) is turned for 180 degrees to restore to the position at the large opening (72). At this moment, the adapting hole (84) on the key II (83) is blocked by the flange (71) in the lock casing (70). When the key II (83) is inserted into the key way (22), the profile of the key II (83) causes the locking keys (40) to displace to different heights so that each locking key (40) has a brake stopper (43) kept in a brake seat (15). Then, the whole assembly is turned by turning the key II (83). As soon as the side plates (50) reach the protrusion portion of the lock casing (70), the side plate springs (81) push the side plates (50) and the brakes (60). By displacement of the side plates (50) in the side slots (42), the brakes (60) are pushed into brake stoppers (43) of different heights from the brake seats (15). Then, the key II (83) is just in the large opening (72) and can be withdrawn therefrom and the profile changing is completed. For unlocking hereafter, a key (85) with a profile identical to the top side of the key II (83) and a bottom width each to the top side of the key II (83) is used. The key (85) may be reproduced for use of two or more users, and the key II (83) is stored separately. Since the key (85) has the same thickness, it can be inserted through the large opening (72) and turned therein for 180 degrees to turn the driving block (24) for opening the door bolt. After unlocking, the key (85) is in the small opening (73). Since the thickness of the key (85) is larger than the width of the small opening (73), it is impossible to withdraw the key (85) from small opening (73) and thus change of profile is not possible.

Figure 7:
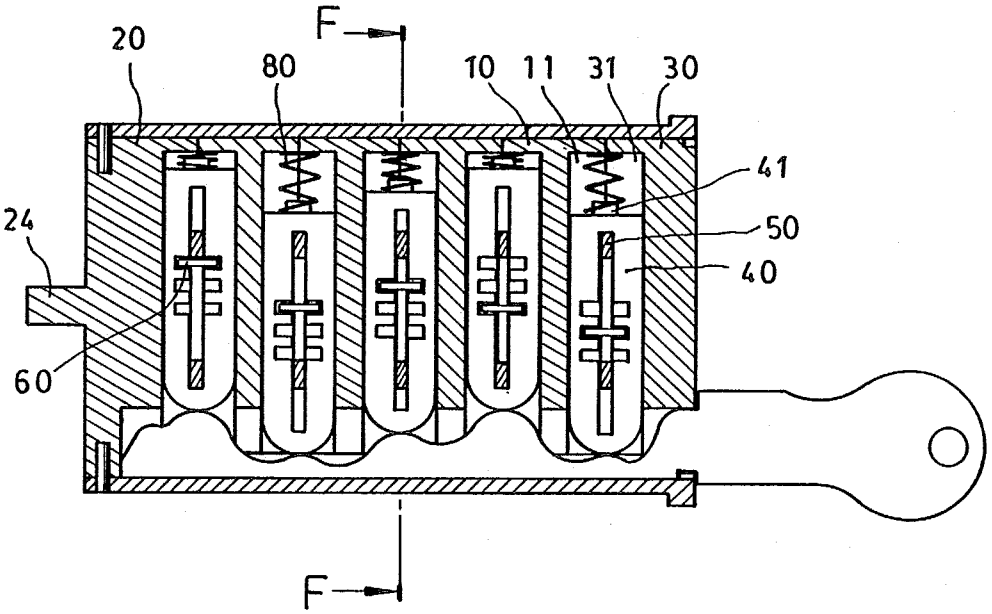
FIG. 7 illustrates that the lock is not unlockable because the brakes are not aligning with the brake seats, according to the present invention.
Figures 1, 7:
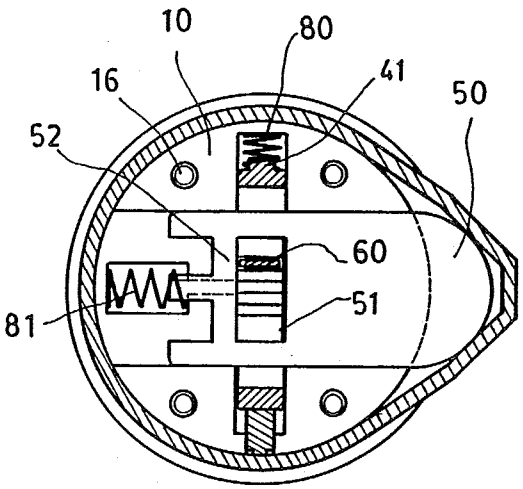

FIG. 7 illustrate that the lock is not unlockable because the brakes (80) according to the present invention are not aligning with the brake seats (15). The brakes (60) are placed in the side plates (50). Even the whole assembly is turned by any key other than that according to the present invention, the adapting edges on the key slots (11) prevent turning of the brakes (60) in the brake stoppers (43) so that unlocking is impossible.

From the above description, we can see that the present invention makes use of the profile of keys so that there are $n^m$ (n=number of brake stoppers, m=number of locking keys) variations of key. Change of key profile does not require removal of the existing barrel, but only resetting by means of the profile changing keys, and prifile of a single barrel can be changed repeatedly. Therefore, the present invention has the following advantages:

1. Numerious variations are available in a single barrel, and thus key profile can be changed without replacement of barrel. Change of profile of lock barrel requires only profile changing keys.

2. Adapting edges on the side plates prevent the brakes from turning in the brake seats by any key other than that according to the present invention and therefore it provides security in a degree than other.

3. There are $n^m$ (n=number of brake stoppers, m=number of locking keys) variations of structure in the present invention, and the possibilities of unlocking by trying without the proper key is very small, and thus it provides security in a degree than other.

I claim:

1. A changeable key type lock barrel comprising a plurality of rotary lock bodies, a driving lock body, a lock panel, a plurality of locking keys, a plurality of side plates, a plurality of brakes, a lock casing, a plurality of locking key springs, a plurality of side plate springs, two profile changing key and a plurality of unlocking keys, characterized by structure of its components as follows:

each rotary lock body is in the form of a disk with two key a side slot is designed perpendicular to each key slot on each side slot there is a spring seat in the form of a semi-cylindrical slot, and there is a brake seat in the form of a rectangular slot extending from an end of the spring seat, each rotary lock body has four cylindrical connection pins, each at a corner, and all located in one side, the other side of the rotary lock body has two connection holes corresponding to the said four connection pins and each of the key slots has an adapting edge on one side;

the driving lock body is in the form of a disk with a long key slot, a side slot is designed perpendicular to the key slot, another side of the driving lock body has a rectangular driving block to open or close door bolt, and on the driving lock body there are four connection holes corresponding to the connection pins;

the lock panel is in the form of a disk with a long key slot at one side and a key way in the bottom of the key slot, a side slot is designed perpendicular to the key slot, on the side slot there is a semi-circular spring seat corresponding to the spring seat on the rotary lock body, a brake seat in the form of a slot is extending from an end of the spring seat and the brake seat is corresponding to the brake seat on the rotary lock body;

the locking key is in the form of a bar with a round end and a spring brake block in the form of a short cylinder on the top, the locking key has a longitudinal side slot, on which there are three (or, two or more) rectangular brake stoppers perpendicular to the side slot;

the side plate is in the form of a thin plate with a round end and three extension plates at another end, it has a rectangular brake holder near the rear end;

the brake is a round (or square with curved edges) thin plate;

the lock casing is in the form of a cylinder with a protrusion along one side, and a flange around the inner wall of one end, the flange has a large opening on the bottom, and a small opening right above the large opening; and each profile changing key has a thin profile on the upper side identical to the unlocking key, a small opening at the lower side, and an adapting hole at the tail; assembled in a manner that, first of all, five (or any other number) brakes are placed in five (or the other number) brake holders of different heights, and such brakes are then inserted into brake stoppers of different heights while the side plate is inserted to the side slot, a locking key spring is placed on the top of each locking key, and tail of each side plate is fixed with a side plate spring so that the locking key springs and the side plate springs are kept respectively in spring seats and top of key slots formed among the rotary lock body, the driving lock body and the lock panel and hence, the side plate is moveable in the side slot under restriction by the side plate spring, and the locking key is moveable under restriction by the locking key spring, such rotary lock bodies are connecting each other by means of the connection pins and the connection holes and then connected to the driving lock body and the lock panel, the whole assembly is then placed in the lock casing in a manner than the key way is matching with the large opening in the lock casing.

2. A changeable key type lock barrel as claimed in claim 1 wherein the width of the side plate is slightly smaller than the width of the side plate so that the side plate can push the brake to move between the brake seat and the brake stopper.

3. A changeable key type lock barrel as claimed in claim 1 wherein displacement of the brake in the brake stopper is restricted by the adapting edge and turning of the driving block by means of any article other than the key according to the present invention can not move the brake.

4. A changeable key type lock barrel as claimed in claim 1 wherein when the profile changing key is inserted in the key way the connection hole is just in the flange of the lock casing and by turning around the flange for 180 degrees till the small opening the profile changing key can be withdrawn through the small opening because of its smaller thickness but turning of the unlocking key in it will not allow withdrawing of the profile changing key from the small opening because the thickness of the unlocking key is greater than width of the small opening.

5. A changeable key type lock barrel as claimed in claim 1 wherein when the profile changing key is inserted into the key way and the whole assembly is turned, the side plate displaces backward along the reducing diameter of the lock casing and pushed the brake on the same center line to the brakeseat, and when the profile changing key is just at the small opening, the profile changing key can be withdrawn from the small opening and replaced by another profile changing key so that the locking keys are displaced to different heights but each locking key has a brake stopper matching with the brake seat, and after turning the profile changing key to restore the whole assembly to the original position and when the profile changing key reaches the large opening, the larger diameter portion of the lock casing cause the side plate spring to push the brakes on the side plates to keep in the brake stoppers of different height so that profile of the lock barrel is changed and new unlocking key is required for locking and unlocking.

* * * * *